US008973591B2

(12) United States Patent
Boyer et al.

(10) Patent No.: US 8,973,591 B2
(45) Date of Patent: Mar. 10, 2015

(54) DISHWASHER WITH A MOTOR DRIVEN FILTER BACKFLUSH SYSTEM AND ASSOCIATED BACKFLUSH METHOD

(75) Inventors: Joel Charles Boyer, Louisville, KY (US); Errin Gnadinger, Louisville, KY (US); Eric B. Devins, Louisville, KY (US)

(73) Assignee: General Electric Company, Schenectady, NY (US)

( * ) Notice: Subject to any disclaimer, the term of this patent is extended or adjusted under 35 U.S.C. 154(b) by 806 days.

(21) Appl. No.: 13/155,724

(22) Filed: Jun. 8, 2011

(65) Prior Publication Data

US 2012/0312337 A1 Dec. 13, 2012

(51) Int. Cl.

| | |
|---|---|
| ***B08B 3/00*** | (2006.01) |
| ***A47L 15/42*** | (2006.01) |
| ***A47L 15/00*** | (2006.01) |

(52) U.S. Cl.

CPC ..... *A47L 15/4208* (2013.01); *A47L 15/0039* (2013.01); *A47L 15/4217* (2013.01); *A47L 15/0023* (2013.01); *A47L 2401/09* (2013.01); *A47L 2501/01* (2013.01)

USPC ..... 134/111; 134/56 D; 134/57 D

(58) Field of Classification Search

None

See application file for complete search history.

(56) References Cited

U.S. PATENT DOCUMENTS

| | | | |
|---|---|---|---|
| 6,832,617 | B2 | 12/2004 | Hegeman et al. |
| 2008/0041419 | A1 | 2/2008 | Gaus |
| 2009/0211600 | A1 | 8/2009 | Steiner et al. |

*Primary Examiner* — Jason Ko

(74) *Attorney, Agent, or Firm* — Dority & Manning, P.A.

(57) ABSTRACT

A dishwasher has a wash chamber and sump disposed below the wash chamber, wherein wash fluid supplied to the wash chamber collects in the sump. A main pump is configured to drawn wash fluid from the sump and supply the wash fluid to the wash chamber, for example via spray arm assemblies. A filter is operably disposed to filter the wash fluid recirculated by the main pump. A backflush line has an outlet disposed downstream of the filter, and a backflush pump is configured to supply backflush fluid through the backflush line against the filter. A reservoir separate from the sump is provided and sized to hold a measured amount of fluid. The backflush pump draws the backflush fluid from the reservoir at a defined time.

15 Claims, 5 Drawing Sheets

DISHWASHER WITH A MOTOR DRIVEN FILTER BACKFLUSH SYSTEM AND ASSOCIATED BACKFLUSH METHOD

FIELD OF THE INVENTION

The present invention relates generally to dishwashers, and more particularly to a system for backflushing filters in the dishwasher.

BACKGROUND OF THE INVENTION

Conventional dishwashers include a main pump and fluid distribution system for circulating wash fluid within the wash chamber via spray arm assemblies or jets. A drain pump and associated drain system are used to drain the wash fluid from the chamber at the appropriate time in the wash cycle. The wash fluid sprayed onto the dishwasher items is collected in a sump located in a lower portion of the wash chamber, and water entering the sump is filtered through one or more pre-pump filters to remove soil and sediment from the washing fluid. In certain dishwashers, one of these filters may be a fine filter system in flow communication with the main pump assembly to remove soil and sediment of a smaller size than those filtered by an upstream coarse filter. The main pump assembly draws wash fluid from the sump to recirculate in the wash chamber, and the coarse and fine filters are used to continuously filter the water in the sump during the re-circulation process.

It is an inherent tendency of the filters to accumulate relatively large amounts of foreign matter over time, particularly at the point at which the water path through the fluid distribution system is of least resistance. This location generally corresponds to the section of the filter directly in line with main pump. Removal of this matter is necessary to ensure proper flow of the wash fluid through the system. Certain prior art systems rely on flushing of the filters with wash fluid that is redirected from the spray arm assemblies or dedicated jets. These systems are relatively complicated and have other inherent drawbacks.

Accordingly, other system designs for flushing filters in a dishwasher in a cost-effective and relatively simple manner would be welcome.

BRIEF DESCRIPTION OF THE INVENTION

Aspects and advantages of the invention will be set forth in part in the following description, or may be obvious from the description, or may be learned through practice of the invention.

According to certain aspects of the present disclosure, a dishwasher includes a wash chamber and a sump disposed below the wash chamber, wherein wash fluid supplied to the wash chamber collects in the sump. A main pump is configured to drawn wash fluid from the sump and recirculate the wash fluid back into the wash chamber, for example through one or more spray arm assemblies. One or more filters are operably disposed in the fluid distribution system to filter the wash fluid recirculated by the main pump. A backflush line is provided and has an outlet disposed at the downstream side of the filter. A backflush pump is configured to supply backflush fluid through the backflush line against the filter. A reservoir that is separate from the sump and sized to hold a measured amount of fluid is in communication with the backflush pump, wherein at a defined time, the pump draws backflush fluid from the reservoir and directs the fluid against the backside of the filter to flush particulates from the filter.

In a particular embodiment, the reservoir is filled with fresh water from a main fill line that is used to initially supply wash fluid to the wash chamber in a fill mode of the wash cycle. This may be accomplished in various ways. For example, in one embodiment, a main water valve in the main fill line is actuated to supply the initial wash fluid in the fill mode. The reservoir may be supplied with fresh water by a supply line that is in communication with the main fill line downstream of the main water valve such that the reservoir is supplied with water during each fill mode. In an alternate embodiment, the supply line may be in communication with the main fill line upstream of the main water valve, wherein an independently actuated isolation valve may be disposed in the supply line. With this embodiment, the reservoir can be filled independently of filling the wash chamber by actuation of the isolation valve for a defined time.

Particular embodiments may include a level sensor configured with the reservoir, wherein the reservoir is refilled upon the sensor reading a low water level condition. The sensor may be in communication with the isolation valve discussed above, wherein the isolation valve is automatically actuated to supply fresh water to the reservoir in response to a water level signal from the sensor.

In still a further embodiment, a main fill line supplies the initial wash fluid for the wash chamber by first filling the reservoir, which has an overflow outlet in fluid communication with the wash chamber. Thus, the wash chamber is filled with overflow after the reservoir has been filled, with the overflow outlet provided at a height in the reservoir to ensure a desired amount of fresh water in the reservoir for one or more flush sequences.

It is not necessary that the reservoir be filled with fresh water in all embodiments. For example, in a particular embodiment, the reservoir may include a receiving end that is in fluid communication with the wash chamber, wherein the reservoir is filled with wash fluid recirculated within the wash chamber by the main pump. With this embodiment, the receiving end of the reservoir may include a receiver structure configured in a wall (e.g. back wall, side wall, or front door panel) of the wash chamber at a location and orientation to "catch" wash fluid supplied into the wash chamber, for example by one or more of the spray arm assemblies.

In certain embodiments, the filter may be disposed upstream of the main pump (e.g., a pre-pump filter) such that particulates backflushed from the filter are directed to the sump during a backflush sequence of the wash cycle. In another embodiment, the filter may be disposed downstream of the main pump such that particulates backflushed from the filter are directed back through the main pump to a drain line or header during the backflush sequence. The dishwasher may include multiple filters, with each respective filter having a backflush line configured therewith.

In particular embodiments, the backflush pump may be a dedicated pump used strictly for filter flushing operations. In other embodiments, one of the other existing pumps, such as a drain pump or main circulation pump, may be configured with the appropriate lines and valves to also function as the backflush pump during the filter flushing sequence.

The present invention also encompasses various method embodiments for backflushing a filter in a dishwasher in accordance with various aspects discussed above.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
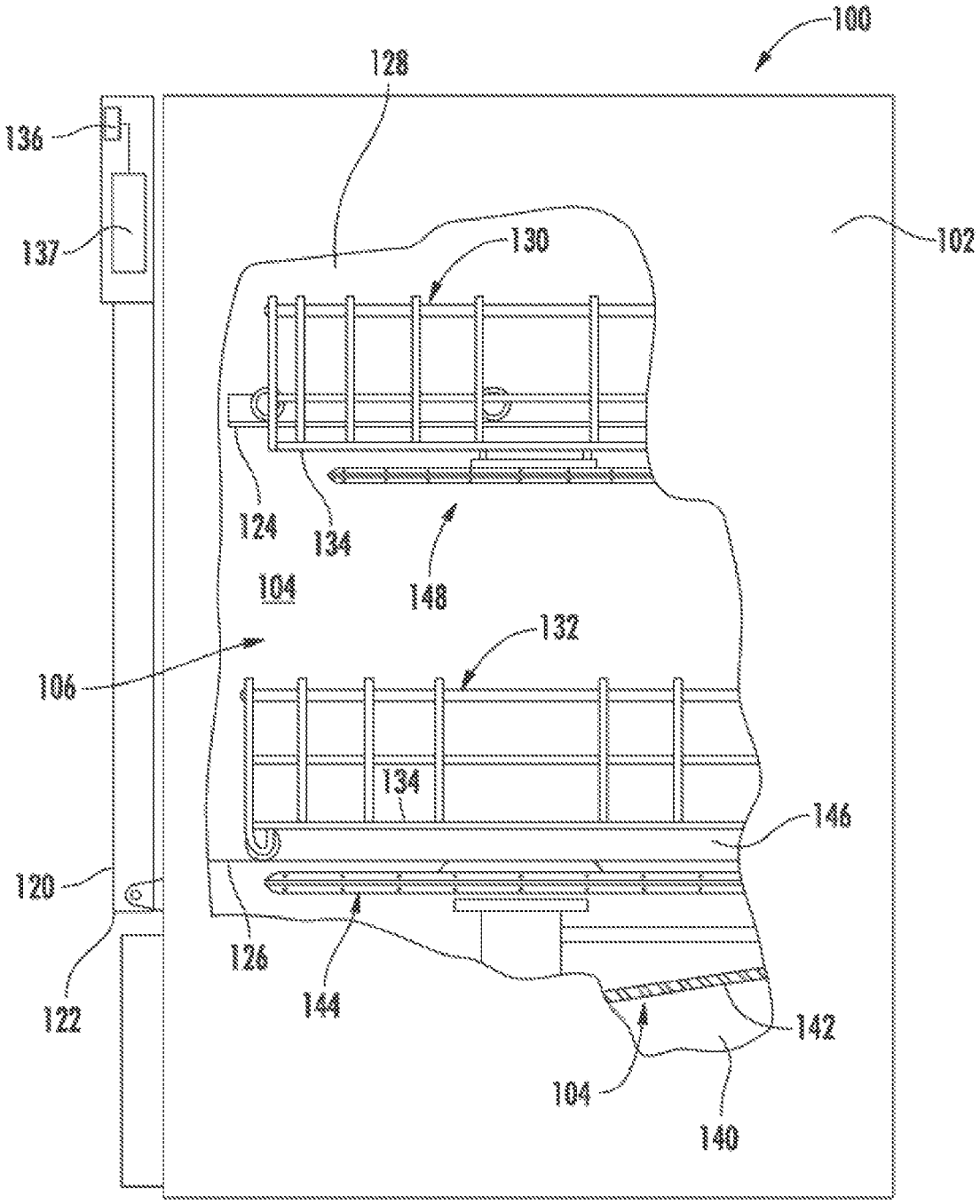
FIG. 1 provides a side partial cut-away view of an exemplary dishwasher that may be configured in accordance with aspects of the invention.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 depicts an exemplary domestic dishwasher 100 that may be configured in accordance with aspects of the disclosure. For the particular embodiment of FIG. 1, the dishwasher 100 includes a cabinet 102 having a tub 104 therein that defines a wash chamber 106. The tub 104 includes a front opening (not shown in FIG. 1) and a door 120 hinged at its bottom 122 for movement between a normally closed vertical position (shown in FIG. 1) wherein the wash chamber 106 is sealed shut for washing operation, and a horizontal open position for loading and unloading of articles from the dishwasher. Upper and lower guide rails 124, 126 are mounted on tub side walls 128 and accommodate upper and lower roller-equipped racks 130, 132, respectively. Each of the upper and lower racks 130, 132 is fabricated into lattice structures including a plurality of elongate members 134, and each rack 130, 132 is adapted for movement between an extended loading position (not shown) in which the rack is substantially positioned outside the wash chamber 106, and a retracted position (shown in FIG. 1) in which the rack is located inside the wash chamber 106. A silverware basket (not shown) may be removably attached to the lower rack 132 for placement of silverware, utensils, and the like, that are too small to be accommodated by the upper and lower racks 130, 132.

The dishwasher 100 further includes a lower spray-arm-assembly 144 that is rotatably mounted within a lower region 146 of the wash chamber 106 so as to rotate in relatively close proximity to the lower rack 132. A mid-level spray-arm assembly 148 is located in an upper region of the wash chamber 106 and may be located in close proximity to upper rack 130. Additionally, an upper spray arm assembly (not shown) may be located above the upper rack 130.

The lower and mid-level spray-arm assemblies 144, 148 and the upper spray arm assembly are fed by a fluid circulation assembly for circulating water and dishwasher fluid in the tub 104. The fluid circulation assembly may be located in a machinery compartment 140 located a bottom sump portion 142 of the tub 104, as generally recognized in the art. Each spray-arm assembly includes an arrangement of discharge ports or orifices for directing washing liquid onto dishes or other articles located in the upper and lower racks 130, 132, respectively. The arrangement of the discharge ports in at least the lower spray-arm assembly 144 provides a rotational force by virtue of washing fluid flowing through the discharge ports. The resultant rotation of the lower spray-arm assembly 144 provides coverage of dishes and other dishwasher contents with a washing spray.

The dishwasher 100 is further equipped with a controller 137 to regulate operation of the dishwasher 100. The controller may include a memory and microprocessor, such as a general or special purpose microprocessor operable to execute programming instructions or micro-control code associated with a cleaning cycle.

The controller 137 may be positioned in a variety of locations throughout dishwasher 100. In the illustrated embodiment, the controller 137 may be located within a control panel area of door 120 as shown. In such an embodiment, input/output ("I/O") signals may be routed between the control system and various operational components of dishwasher 100 along wiring harnesses that may be routed through the bottom 122 of door 120. Typically, the controller 137 includes a user interface panel 136 through which a user may select various operational features and modes and monitor progress of the dishwasher 100. The user interface 136 may include a display component, such as a digital or analog display device designed to provide operational feedback to a user. The user interface 136 may be in communication with the controller 137 via one or more signal lines or shared communication busses.

It should be appreciated that the invention is not limited to any particular style, model, or other configuration of dishwasher, and that the embodiment depicted in FIG. 1 is for illustrative purposes only. For example, instead of the racks 130, 132 depicted in FIG. 1, the dishwasher 100 may be of a known configuration that utilizes drawers that pull out from the cabinet and are accessible from the top for loading and unloading of articles.

Figure 2:
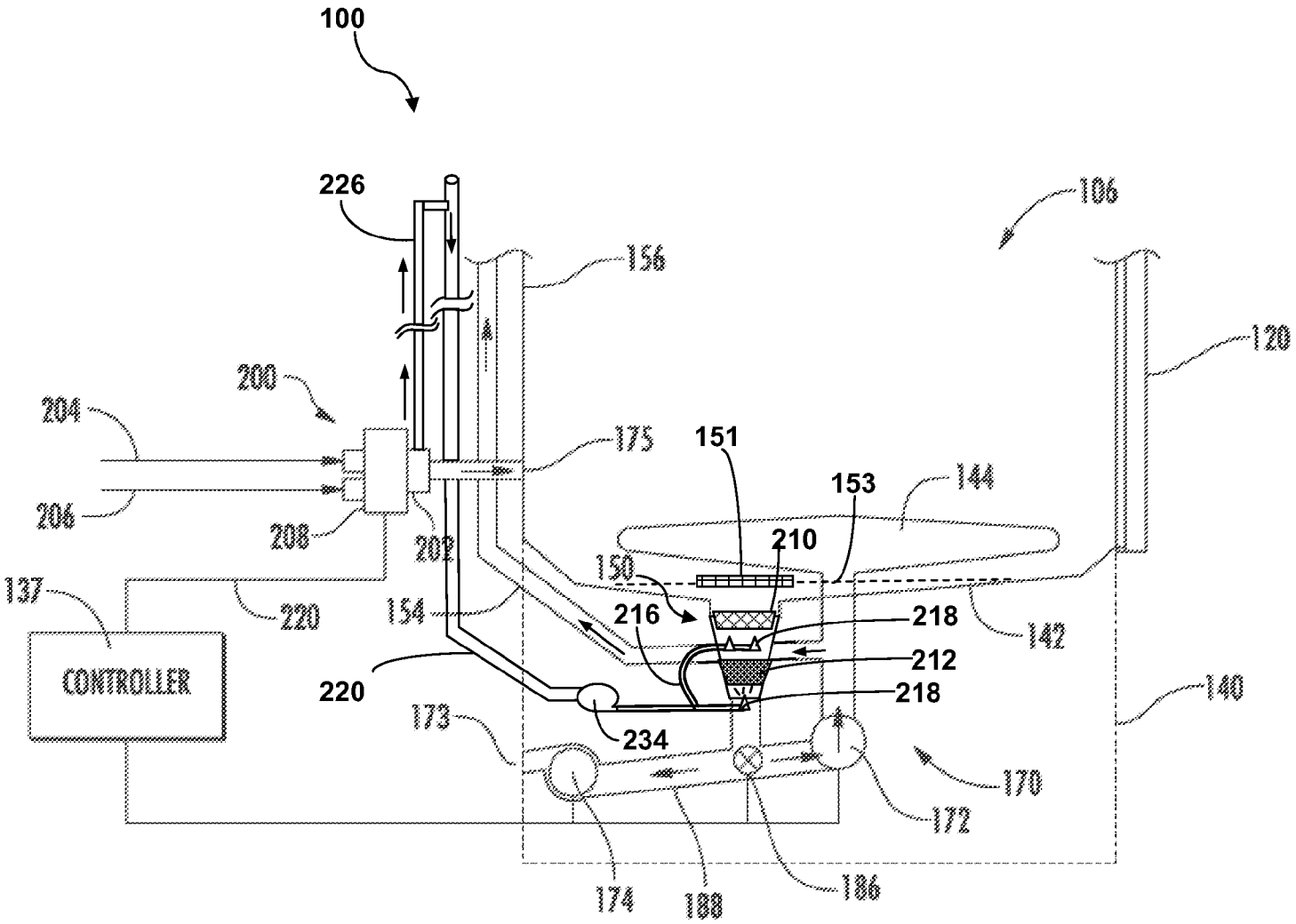
FIG. 2 is a schematic view of an embodiment of a dishwasher incorporating a filter backflush system in accordance with aspects of the invention.

FIG. 2 illustrates an embodiment of a dishwasher 100 incorporating a filter backflush capability. The dishwasher 100 includes a fluid circulation assembly 170 configured below the wash chamber 106. Although one embodiment of a fluid circulation assembly 170 is shown, it is contemplated that other fluid circulation assembly configurations may similarly be utilized without departing from the spirit and scope of the invention. The fluid circulation assembly 170 includes a circulation pump assembly 172 and a drain pump assembly 174, both in fluid communication with the sump 150. Additionally, the drain pump assembly 174 is in fluid communication with an external drain 173 to discharge used wash liquid. Further, the circulation pump assembly 172 is in fluid communication with lower spray arm assembly 144 and conduit 154 which extends to a back wall 156 of wash chamber 106, and upward along the back wall 156 for feeding wash liquid to the mid-level spray arm assembly 148 (FIG. 1) and the upper spray arm assembly. This configuration also applies to a drawer-type of dishwasher, as mentioned above.

As wash liquid is pumped through the lower spray arm assembly 144, and further delivered to the mid-level spray arm assembly 148 (FIG. 1) and the upper spray arm assembly 145 (FIG. 5), washing sprays are generated in the wash chamber 106, and wash liquid collects in the sump 150. The sump 150 may include a perforated plate 153 through which wash fluid drains, as well as cover 151 to prevent larger objects from entering the sump 150, such as a piece of silverware or another dishwasher item that is dropped beneath lower rack 132.

In one embodiment, a drain valve 186 is established in flow communication with the sump 150 and opens or closes flow communication between the sump 150 and a drain pump inlet line 188. The drain pump assembly 174 may include an electric motor for pumping fluid from the inlet line 188 to an external drain system via drain 173. In one embodiment, when the drain pump is energized, a negative pressure is created in the drain pump inlet line 188 and the drain valve 186 is opened, allowing fluid in the sump 150 to flow into the inlet line 188 and be discharged from the fluid circulation assembly 170 via the external drain 173.

Referring to FIG. 2, a water supply 200 may be configured with the inlet port 175 for supplying wash liquid to the wash chamber 106. The water supply 200 may provide hot water only, cold water only, or either selectively as desired. As depicted, the water supply 200 includes a hot water inlet 204 and cold water inlet 206 to a main fill valve 208. Upon actuation of the valve 208, initial fill water is discharged through the valve 208 and a main fill line 202 into the wash chamber 106 via inlet 175. It should be understood that the term "water supply" is used herein to encompass any manner or combination of valves, lines or tubing, housing, and the like, and may simply comprise a conventional hot or cold water connection.

Embodiments of a dishwasher 100 in accordance with aspects of the invention include one or more filters in the fluid circulation assembly 170. The invention is not limited to any particular number of filters, type of filter, and so forth. In the embodiment depicted in FIG. 2, a coarse filter 210 is disposed in the sump 150 and serves to filter relatively large particulate matter from the wash fluid that drains into the sump 150. An additional "finer" filter 212 is disposed in the sump 150 below the coarse filter 210 and serves to filter out smaller particulate matter that passes through the coarse filter 210. The filters 210, 212 depicted in FIG. 2 are pre-pump filters in that they are disposed on the suction side of the main circulation pump 172 and serve to filter the re-circulated wash fluid before it is discharged by the pump 172. The invention is not, however, limited to pre-pump filters. For example, in the embodiment depicted in FIG. 3, a coarse filter 210 is located upstream (pre-pump) of the pump 172 and a finer filter 212 is disposed on the downstream side of the pump 172 and functions to filter out finer particular matter that is discharged by the pump 172 prior to the wash fluid being distributed to the spray arm assemblies 144, 145, 148 or other wash fluid distribution devices within the wash chamber 106.

It should be appreciated that the invention is not limited to any particular type of filter 210, 212 within the fluid circulation system 170. Conventional filters are well known in this regard, and any one or combination of such filters may be utilized with the present invention. For example, the filters 210, 212 may be removable filters that are seated within the lines or piping of the circulation assembly 170. The filters may have a conical shape, or a flat plate-like shape, and so forth.

Referring again to FIG. 2, a backflush line 216 is provided in the fluid circulation assembly 170 and includes an outlet 218 that is disposed "downstream" of the respective filter 210, 212. The outlet 218 is on the downstream side of the filter with reference to fluid flow through the filter during the wash cycle wherein the pump 172 draws the wash fluid from the sump 150 through the filters 210, 212. The backflush line 216 may be any configuration of suitable conduit, including flexible hoses, pipes, and so forth. The outlet 218 may be variously configured. For example, the outlet 218 may be a nozzle that is configured to direct a relatively high-pressure spray against the downstream side of the respective filter 210, 212, as depicted in FIG. 2. The outlet 218 may, in this regard, include any manner of discharge port, orifice, and the like.

A backflush pump 234 is configured with the backflush line 216 and supplies backflush fluid through the line 216 against the filters. In the depicted embodiment, the backflush pump 234 is a separate dedicated pump for this purpose. It should be appreciated, however, that the invention is not limited to a dedicated pump 234. For example, either of the other pumps 172, 174 may be operably configured to also function as a backflush pump with appropriate connections, isolation valves, and so forth.

A reservoir 220 that is separate from the sump 150 is configured with the backflush pump to provide a supply of backflush fluid to the pump. The reservoir 220 may have any suitable configuration and be located at any convenient location within the dishwasher 100. For example, the reservoir 220 in the embodiment of FIG. 2 may have a standpipe configuration with a sufficient volume to provide a measured amount of backflush fluid to the pump 234 in one or more filter flushing sequences. The reservoir 220 may be located alongside the conduit 154 that supplies the upper and mid-level spray arm assemblies 145, 148. In an alternative embodiment, the reservoir 220 may have a tank-like configuration and be located, for example, within a corner of the cabinet structure 102 (FIG. 1). In still further embodiments, the reservoir 220 may have a panel-configuration and be disposed along one of the sides of the cabinet 102. It should be appreciated that the reservoir 220 may be variously configured within the scope and spirit of the invention.

In certain embodiments, the reservoir 220 is filled with fresh water that has not been previously recycled in the wash chamber 106. This fresh water may be supplied with the initial filling of the wash chamber 106. For instance, as depicted in FIG. 2, the reservoir 220 may be supplied via a supply line 226 that is in fluid communication with the main water supply 200, for example by connection with the main fill line 202. The supply line 226 may be downstream of the main fill valve 208 such that the reservoir 220 is filled upon actuation of the valve 208 to supply the initial wash fluid into the chamber 106 via the outlet 175. Although not depicted in FIG. 2, a separate isolation valve may be provided in the supply line 226 in order to limit the amount of water delivered into the reservoir 220 during the fill mode of the wash cycle.

In the embodiment of FIG. 2, the supply line 226 that fills the reservoir 220 with fresh water is in communication with the water supply 200 upstream of the valve 208. An isolation valve 228 is separately provided in the supply line 226 such that actuation of the valve 228 results in water being directed into the reservoir 220. The isolation valve 228 is in communication with the controller 137 and can be actuated independently of the main fill valve 208. Thus, in this embodiment, the reservoir 220 can be re-filled at any time, and is not dependent on actuation of the main fill valve 208 for a wash cycle.

Figure 3:
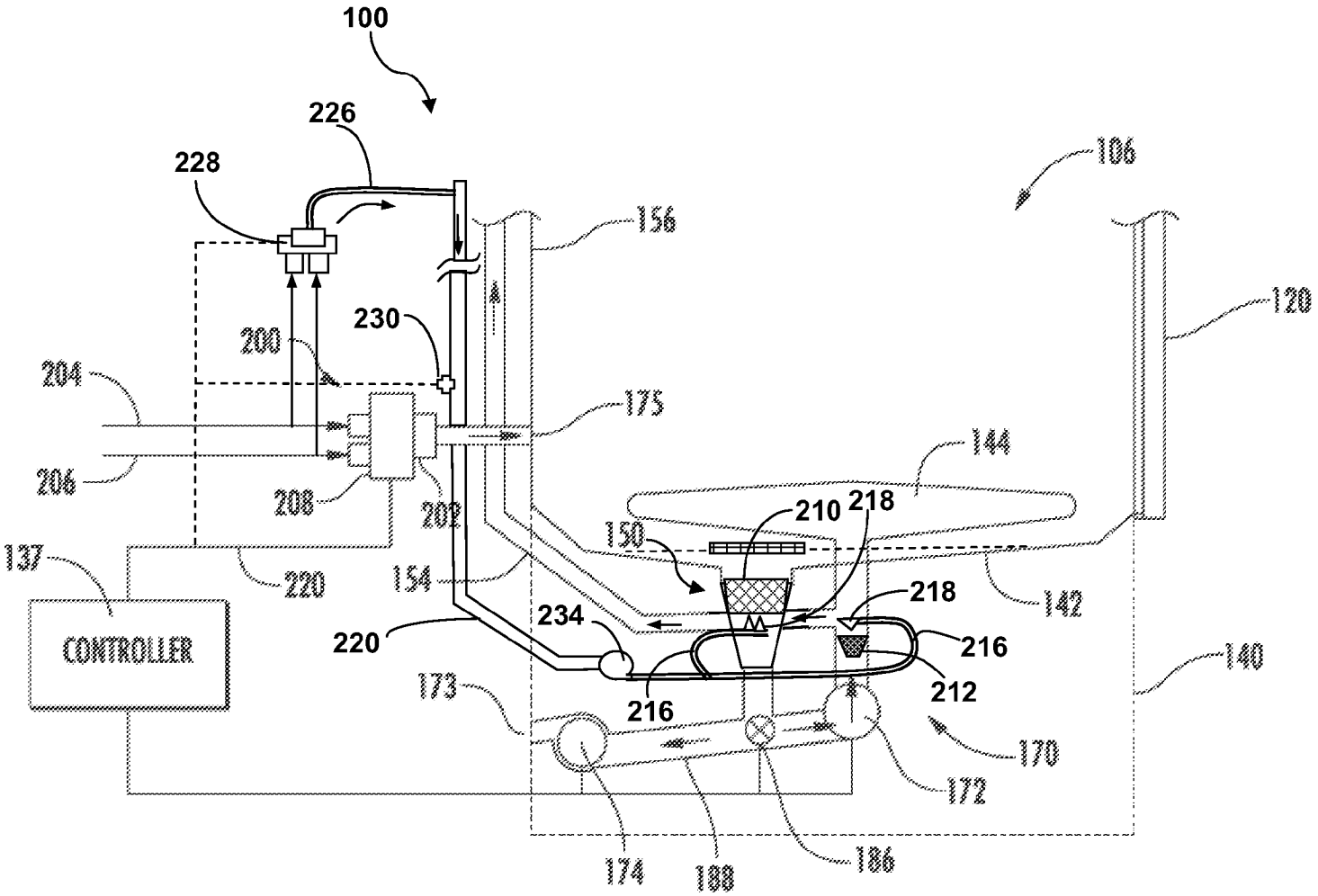
FIG. 3 is a schematic view of a different embodiment of a dishwasher incorporating a filter backflush system.

In the embodiment of FIG. 3, any manner of suitable liquid level sensor 230 may be provided with the reservoir 220 to sense a low level condition within the reservoir. The sensor 230 may also be in communication with the controller 137, which issues a command to the isolation valve 228 to open and thus allow filling of the reservoir 220 upon indication of a low level within the reservoir 220.

Figure 4:
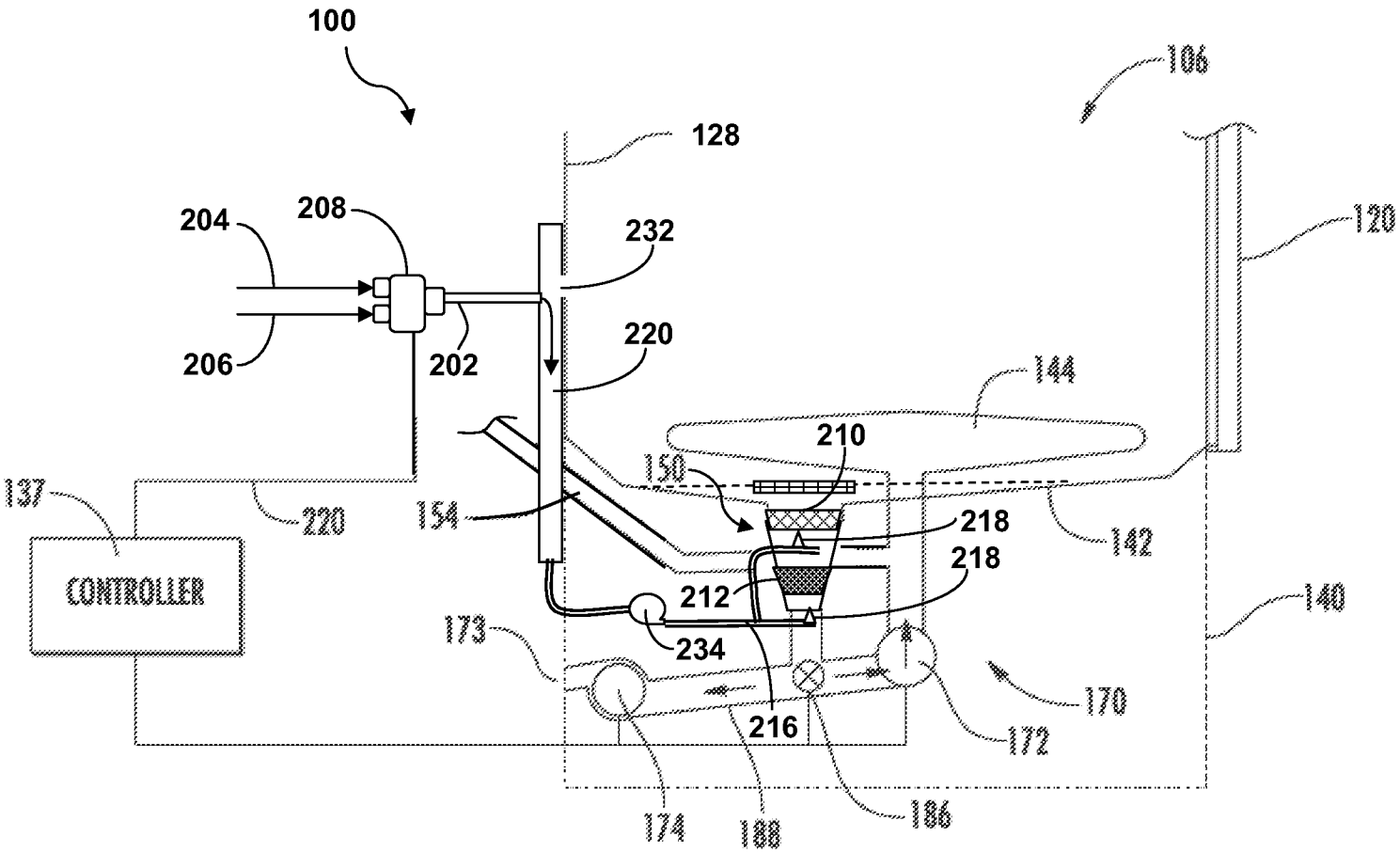
FIG. 4 is a schematic view of still another embodiment of a dishwasher incorporating a filter backflush system.

In the embodiment depicted in FIG. 4, the main fill valve 208 directs water into the reservoir 220 via the main fill line 202. This is different than the embodiments of FIGS. 2 and 3 wherein the main fill line 202 empties directly into the wash chamber 106 via the outlet 175. The reservoir 220 includes an overflow outlet 232 that opens directly into the wash chamber 106. Once the water level within the reservoir 220 reaches the outlet 232, continued filling of the reservoir results in overflow of the water into the wash chamber 106. This operation continues until the desired amount of initial wash fluid is supplied to the wash chamber 106. Thus, the reservoir 220 is initially filled with a predetermined amount of water, at which point the overflow continues in order to supply the wash chamber 106.

Figure 5:
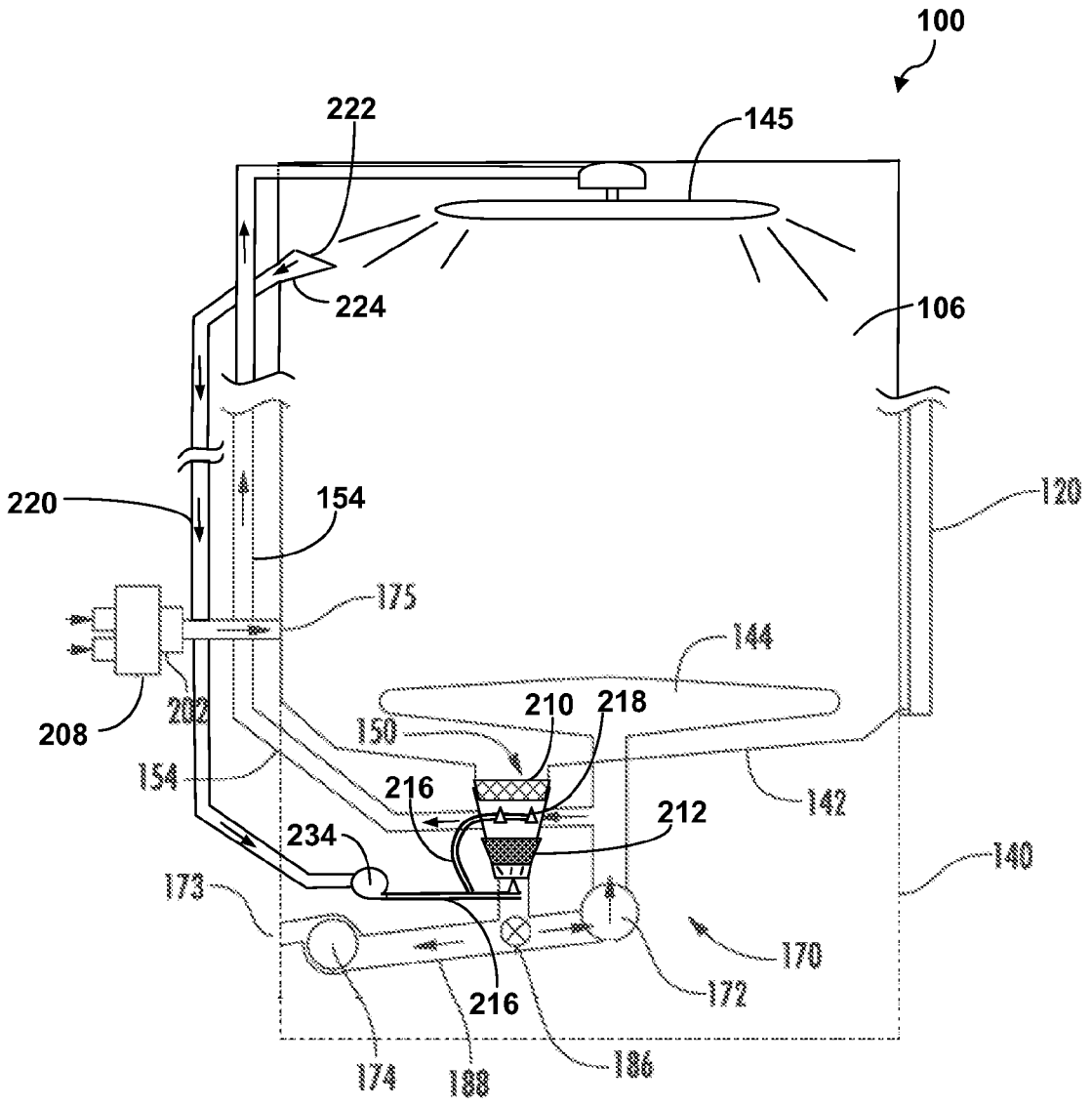
FIG. 5 is a schematic view of yet another embodiment of a dishwasher incorporating a filter backflush system.

FIG. 5 depicts yet another embodiment wherein the reservoir 220 is filled with re-circulated wash fluid from the chamber 106. The reservoir 220 has a receiving end 222 that is open to the wash chamber 106 such that water re-circulated within the chamber 106, for example via one of the spray arm assemblies, is also directed into the reservoir 220. In this regard, any manner of suitable receiving structure 224 may be configured at the receiving end 222 in order to "catch" the water sprayed from the spray arm assembly 145. Thus, it should be appreciated that in this particular embodiment, the reservoir 220 is not filled with "fresh water", but with re-circulated wash fluid. The receiving end 222 may be configured in any wall of the wash chamber 106 depending on the location of the reservoir 220, including the back wall, side walls, or in the front door panel.

As mentioned, the invention is not limited by the location of the filters 210, 212. In the embodiment of FIGS. 2 and 4, the filters are upstream with respect to the main circulation pump 172. Thus, backflushing of the filters via the backflush line 216 results in the particulates on the filter being directed back into the sump 150. In the embodiment of FIG. 3, the filter 212 is downstream of the main circulation pump 172 and, thus, backflushing of the filter will result in particulate matter being directed back through pump to the drain pump header 188.

The present invention also encompasses various method embodiments for backflushing a filter or filters in a dishwasher in accordance with aspects discussed above. For example, one embodiment of such a method includes collecting backflush fluid in a reservoir 220 that is separate from a sump 150 in a dishwasher 100. During a backflush sequence, fluid is drawn from the reservoir 220 with a pump and directed against a downstream side of the filter 210, 212. The pump may be a dedicated backflush pump 234.

The method may include filling the reservoir 220 with fresh water that has not been re-circulated as wash fluid within the wash chamber 106. In another embodiment, the method includes filling the reservoir with wash fluid that has been re-circulated in the wash chamber 106.

The method may also include sensing the level of backflush fluid within the reservoir 220 and re-filling reservoir upon the level reaching a low set point.

In still another embodiment, the method may include initially filling the reservoir 220 in a fill mode with fresh water until the reservoir is filled to an overflow outlet that is in communication with a wash chamber, wherein continued filling of the reservoir results in overflow of fresh water into the wash chamber from the reservoir.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dishwasher, comprising:
a wash chamber;
a sump disposed below said wash chamber, wherein wash fluid supplied to said wash chamber collects in said sump;
a main pump configured to draw wash fluid from said sump and supply the wash fluid to said wash chamber;
a filter operably disposed to filter the wash fluid recirculated by said main pump;
a backflush line having an outlet disposed downstream of said filter;
a backflush pump configured to supply backflush fluid through said backflush line against said filter;
a reservoir sized to hold a measured amount of fluid, said backflush pump configured with said reservoir to draw the backflush fluid from said reservoir at a defined time, and said reservoir fluidly separate from said sump except for the backflush fluid drawn by said backflush pump.

2. The dishwasher as in claim 1, wherein said reservoir is configured to be filled with fresh water from a main fill line used to initially supply wash fluid to said wash chamber in a fill mode of the wash cycle.

3. The dishwasher as in claim 1, further comprising a main water valve in said main fill line that is actuated to supply the initial wash fluid in the fill mode, said reservoir supplied with fresh water by a supply line in communication with said main fill line downstream of said main water valve.

4. The dishwasher as in claim 2, further comprising a main water valve in said main fill line that is actuated to supply the initial wash fluid in the fill mode, said reservoir supplied with fresh water by a supply line in communication with said main fill line upstream of said main water valve, and further comprising an isolation valve disposed in said supply line, wherein actuation of said isolation valve for a defined time supplies the measured amount of fresh water to said reservoir.

5. The dishwasher as in claim 4, further comprising a level sensor configured with said reservoir, said isolation valve actuated to supply fresh water to said reservoir in a response to a water level signal from said sensor.

6. The dishwasher as in claim 2, wherein said main fill line supplies the initial wash fluid in the fill mode into said reservoir, said reservoir having an outlet in fluid communication with said wash chamber such that overflow from said reservoir fills said wash chamber, said outlet defined at a height in said reservoir to define the measured amount of fresh water in said reservoir.

7. The dishwasher as in claim 1, wherein said reservoir comprises a receiving end in fluid communication with said wash chamber, wherein said reservoir is filled with wash fluid recirculated within said wash chamber by said main pump.

8. The dishwasher as in claim 7, wherein said receiving end comprises a receiver configured in a wall of said wash chamber at a location and orientation to catch wash fluid distributed by one or more of said spray arm assemblies.

9. The dishwasher as in claim 1, wherein said filter is disposed upstream of said main pump such that particulates backflushed from said filter are directed to said sump during a backflush mode of the wash cycle.

10. The dishwasher as in claim 1, wherein said filter is disposed downstream of said main pump such that particulates backflushed from said filter are directed back through said main pump to a drain line during a backflush mode of the wash cycle.

11. The dishwasher as in claim 1, comprising multiple said filters, with each said filter having a respective said backflush line configured therewith.

12. The dishwasher as in claim 1, wherein said backflush pump is a dedicated pump for backflushes.

13. A dishwasher, comprising:

a wash chamber;

a sump disposed below said wash chamber, wherein wash fluid supplied to said wash chamber collects in said sump;

a main pump configured to draw wash fluid from said sump and supply the wash fluid to said wash chamber;

at least one filter operably disposed to filter the wash fluid recirculated by said main pump;

a backflush line having an outlet disposed downstream of said at least one filter, said outlet directed against the downstream side of said at least one filter;

a backflush pump configured to supply backflush fluid through said backflush line during a backflush mode of a wash cycle;

a reservoir separate from said sump and sized to hold a measured amount of backflush fluid, said backflush pump configured with said reservoir to draw the backflush fluid from said reservoir during the backflush mode.

14. The dishwasher as in claim 13, wherein said reservoir comprises a vertically oriented standpipe having an elongated cylindrical cavity disposed therein.

15. The dishwasher as in claim 13, wherein said at least one filter comprises a coarse filter and a fine filter, each said filter having a respective said backflush line configured therewith.

* * * * *